9/28/82 XR 4,352,044

United States Patent [19]

Zhukov et al.

[11] 4,352,044

[45] Sep. 28, 1982

[54] PLASMA GENERATOR

[76] Inventors: Mikhail F. Zhukov, ulitsa Zolotodolinskaya, 28, Novosibirsk; Albert Y. Lytkin, kvartal 3a, 9, kv. 19, Lytkarino Moskovskoi oblasti; Georgy N. Khudyakov, ulitsa Valtera Ulbrikhta 21, kv. 58, Moscow; Anatoly S. Anshakov, ulitsa Pravdy, 7, kv. 16, Novosibirsk, all of U.S.S.R.

[21] Appl. No.: 222,648

[22] Filed: Jan. 5, 1981

[51] Int. Cl.[3] ..... H05H 1/42; H05H 1/44

[52] U.S. Cl. ..... 315/111.21; 219/121 PM; 313/231.41

[58] Field of Search ..... 315/111.11, 111.21; 313/231.31, 231.41, 231.51; 219/121 PM, 121 PP, 121 PQ

[56] References Cited

U.S. PATENT DOCUMENTS

| | | | |
|---|---|---|---|
| 2,951,143 | 8/1960 | Anderson et al. | 219/121 PM X |
| 2,972,696 | 2/1961 | Kantrowitz et al. | 313/231.41 |
| 3,149,222 | 9/1964 | Giannini et al. | 313/231.41 X |
| 3,453,474 | 7/1969 | Cann et al. | 313/231.31 X |

FOREIGN PATENT DOCUMENTS

| | | | |
|---|---|---|---|
| 2162024 | 9/1972 | Fed. Rep. of Germany | 315/111.21 |
| 452725 | 5/1968 | Switzerland | 315/111.21 |

*Primary Examiner*—Eugene R. LaRoche
*Attorney, Agent, or Firm*—Holman & Stern

[57] ABSTRACT

A plasma generator comprises a discharge chamber provided with a means for introducing a plasma-forming medium and associated with a cathode assembly and an anode assembly. The latter includes at least two plasmatrons each having a hole for an inlet for the plasma-forming medium and being provided with an end electrode and an auxiliary hollow electrode. These electrodes are connected to an arc discharge initiating system. The exit openings of the auxiliary electrodes communicate with the discharge chamber and are evenly distributed along the perimeter of its cross section. The cathode assembly comprises at least two plasmatrons each having an inlet for the plasma-forming medium and being provided with an end electrode and an auxiliary hollow electrode. Both electrodes are connected to an arc discharge initiating system. In addition, the end electrodes are connected to the power supply. The exit openings of the auxiliary electrodes communicate with the discharge chamber and are evenly distributed along the perimeter of its cross section. The diameter of each exit opening of the auxiliary electrode of each plasmatron of each assembly, both cathode and anode, is selected to satisfy a specific relationship.

1 Claim, 1 Drawing Figure

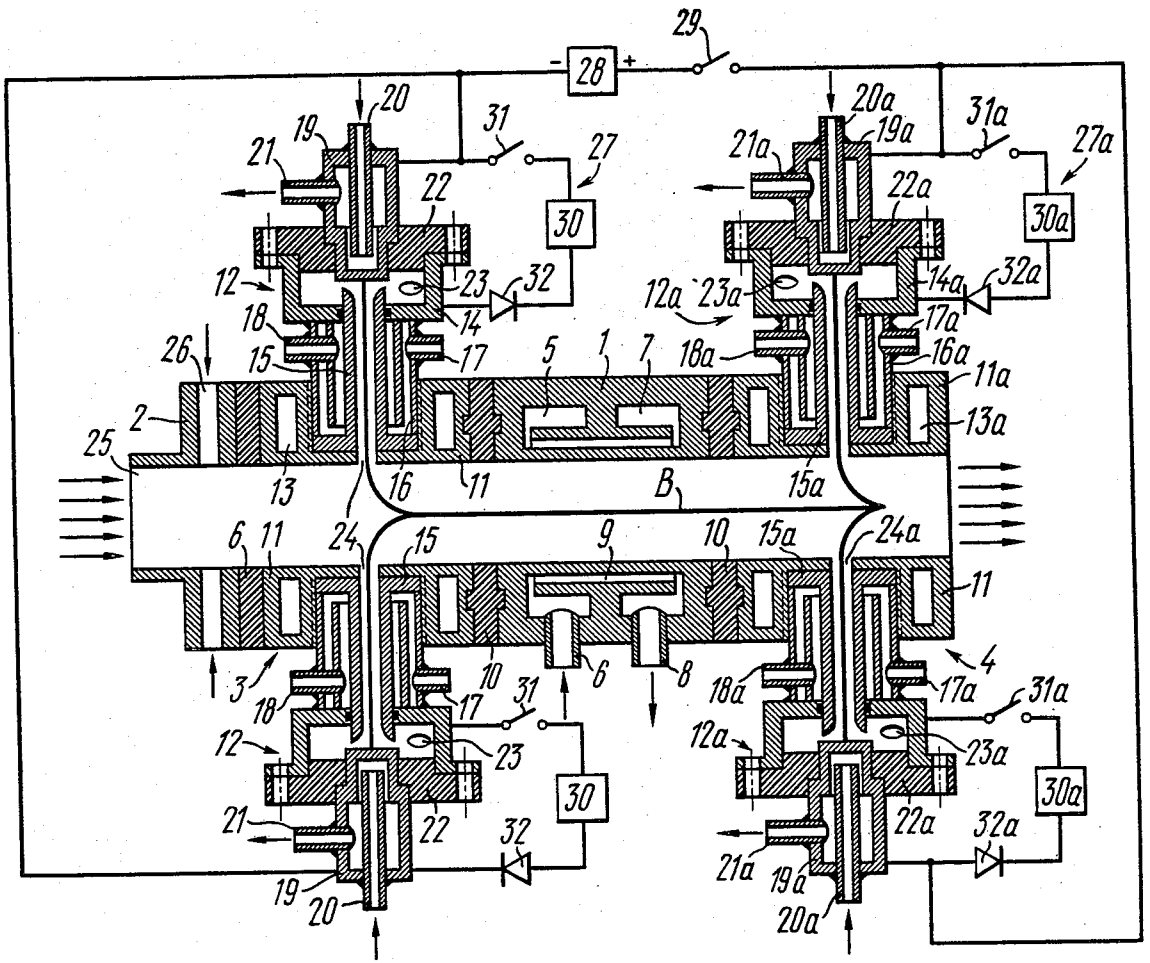

PLASMA GENERATOR

The present invention relates to electroplasmadynamic devices, and more particularly to plasma generators.

The invention can most advantageously be used in conversion of solid fuels to gaseous products containing CO and $H_2$, on the basis of which synthetic liquid fuels and hydrogen are produced.

The present invention can also be successfully used in plasma generators wherein a mixture of a gaseous medium and a solid, for example a gaseous oxidizing agent such as steam and oxygen plus a pulverized solid fuel, is supplied directly into a zone in which an electric discharge produced by a dc and, particularly, ac source is sustained.

The prior art plasma generator designs do not meet the power and continuous operation requirements imposed by the industry because of the insufficient unit power of their basic components, which hinders such processes as plasmochemical fixation of atmospheric nitrogn, gasification and plasma pyrolysis of gaseous, liquid and solid fuels to be introduced on a commercial basis.

The existing plasma generators are designed to operate continuously for several hundred hours, the unit power of a plasma generator being approximately 10 megawatts. The increasing demand of the industry in synthetic fuel and nitrogen fertilizers calls for plasma generators capable of operating continuously for 5,000 to 10,000 hours at a unit power of 50 to 100 megawatts.

Plasma beams for various industrial processes are normally produced by plasma generators comprising a discharge chamber and mutually insulated electrodes. An electric arc discharge is initiated in the discharge chamber between the electrodes, in the flow of a medium. The latter is heated in the discharge to the plasma state and flows out of the generator in the form of a plasma jet.

The most widely used are plasma generators energized by a dc source: they are simplest in design, most efficient as far as conversion of electrical to thermal energy is concerned, and easiest to control.

AC plasma generators have not found broad application because of the heavy erosion of the electrodes and insufficient stability of ac arc discharges as a result of incessant electrode polarity reversals and passage of the arc current through zero.

Of all plasma generator components, electrodes, or rather their surfaces exposed to the electric arc (so-called "arc-spots"), are under the least favorable thermal conditions. The thermal flux density in these areas may reach $10^5$ to $10^6$ W/cm$^2$ at current as great as several thousand amperes. All known metals melt and evaporate under such conditions. Hence, erosion of the electrodes, that is destruction of their surfaces, which substantially cuts down the service life of a plasma generator. The electrode erosion is heaviest in plasma generators operating on media chemically active with respect to the electrode material, namely, steam and oxygen.

A positive solution of the problem of a plasma generator's life largely depends on the ability to minimize the thermal effect of the electric arc on the electrodes, as well as adequate protection of the electrode surface against the erosive medium. This is normally achieved by applying a gas-dynamic or electromagnetic field to the "arc spots" to move them rapidly over the electrode surface, whereby the mean thermal flux is reduced in density, as well as by supplying protective flows of neutral gases to the areas of contact between the electrodes and electric arc.

Another effective way to control electrode erosion is distribution of the current of the main arc discharge among several discharges, whereby the thermal effect on each one of the parallel-connected electrodes of the electrode assembly, for example the anode, is mitigated.

Attempts to provide plasma generators with distribution of the main discharge current among several arcs in the area of contact between the electrodes and the electric arc have lead to a concept described in U.S. Pat. No. 2,951,143.

In this plasma generator one of the electrodes is made as a cooled copper ring into which rods of a refractory metal such as tungsten are embedded. The ends of the rods protrude into the plasma jet and take up all of the current load.

A disadvantage of this design is the possibility of operating only with gases inert with respect to the refractory material of the rods. Another drawback is sticking of the fine powder to the protruding ends of the rods when a medium containing powdered materials is fed into the discharge chamber. This substantially reduces the efficiency of the above plasma generator.

Another plasma generator is known from a monograph by A. V. Donskoy and V. S. Klubnikin, entitled "Electroplasmadynamic Processes and Devices in Mechanical Engineering" ("Mashinostroyenie" Publishers, Leningrad, 1979, p. 94, in Russian).

This plasma generator comprises a discharge chamber associated with a cathode and an anode assembly made of several anodes mounted on hollow tubes, and a system for supplying reagents and a neutral gas to protect the surfaces of the cathode and each anode against the erosive medium created by the reagents. The cathode is connected to the negative terminal of a power supply, while all anodes are connected in parallel to the positive terminal of the power supply. The cathode and all anodes are insulated from the body of the discharge chamber by means of insulators.

In this design the electric-arc discharge in the anode area of the discharge chamber is divided into n independent arcs, n being the number of anodes in the anode assembly. Thus, the erosion of the anodes, particularly when they are blown with an inert gas, is reduced according to the number of independent arcs into which the main discharge in the anode area is divided. This plasma generator is energized by a single power supply. One of the serious drawbacks of this design is the need to connect a ballast resistor in series with each anode to stabilize the arc discharges in the anode assembly by limiting the arc current when the voltage in the circuitry of the plasma generator inadvertently drops. Such stabilization of the discharge enables the arc current to be evenly distributed among several anodes. This produces a positive effect on the life of individual anodes but does not increase the overall life of the plasma generator as a whole because all of the arc current flows through a single cathode and when the arc current exceeds the rated value, the life and reliability of the cathode are adversely affected.

Such a plasma generator cannot be used in the production of a synthetic gas ($CO+H_2$) by plasma gasification of a solid fuel in the discharge chamber in the presence of an oxidizing agent (steam$+O_2$) because the solid fuel blocks the channels for supplying the plasma-forming medium.

In addition, the electric power losses are sunstantial since about half the supplied power is lost at the ballast resistors.

Another plasma generator with a multielectrode anode assembly is known in the prior art (see British Pat. No. 1,346,790).

It comprises a discharge chamber associated with a cathode assembly and an anode assembly, the latter being designed as a plurality of plasmatrons each being provided with an end electrode and an auxiliary hollow electrode, as well as an inlet (pipe) for a plasma-forming medium.

The cathode assembly comprises a single cathode and an inlet for a plasma-forming gas. The reagent feeding system is designed to ensure separate supply of the reagents: a protective gas is fed to the plasmatrons of the anode assembly, while an erosive medium is supplied into the discharge chamber. The plasma generator is coupled to a power supply consisting of n dc generators, n being the number of plasmatrons in the anode assembly. The positive terminal of each dc generator is connected to a respective end electrode of one of the plasmatrons of the anode assembly, and the negative terminals of all dc generators are connected to the cathode. Each dc generator is provided with a system for initiating a discharge between the electrodes of a respective plasmatron and an auxiliary discharge between the cathode and the wall of the discharge chamber.

The discharge initiating systems of all dc generators are de-energized immediately after the main discharge has been initiated in the discharge chamber, the cathode portion of the discharge being in contact with the cathode, while the anode portion is divided into n parallel arcs contacting the end electrodes of the plasmatrons.

However, this design does not solve the problem of providing a powerful source of a plasma jet either, because of the limited life of the cathode through which all of the discharge current flows. Besides, the channels for feeding the plasma-forming medium into the discharge chamber are so designed that a mixture of a pulverized solid fuel and an oxidizing agent cannot be fed continuously because of frequent blocking of the passages. The power supply system of this plasma generator, incorporating a plurality of sources, renders the generator complex and expensive without ensuring even distribution of the arc current in the discharge chamber, among the plasmatrons of the anode assembly.

It is, therefore, an object of the present invention to prolong the life of a plasma generator by minimizing erosion and equalizing wear of its electrodes.

Another object of the invention is to enhance the efficiency of the power supply system and to simplify it by sustaining an arc with a rising current-voltage characteristic.

Still another object of the invention is to increase the unit power of a plasma generator by decreasing the current through the electrodes.

These and other objects are attained by that, in a plasma generator whose discharge chamber is provided with a means for introducing a plasma-forming medium and associated with a cathode and anode assemblies, the latter incorporating at least two plasmatrons each having an inlet for the plasma-forming medium and being provided with an end electrode and an auxiliary hollow electrode, both being connected to an arc discharge initiating system, the end electrodes being connected to an electric power supply, the exit openings of the auxiliary hollow electrodes communicating with the discharge chamber and being evenly distributed along the perimeter of its cross section, according to the invention, the cathode assembly comprises at least two plasmatrons each having an inlet for the plasma-forming medium and being provided with an end electrode and an auxiliary hollow electrode, both being connected to the arc discharge initiating system, the end electrodes of the cathode assembly being connected to the electric power supply, the exit openings of the auxiliary hollow electrodes of the cathode assembly communicating with the discharge chamber and being evenly distributed along the perimeter of its cross section, and the diameter of each exit opening of the auxiliary hollow electrodes of the plasmatrons of both cathode and anode assemblies being selected to satisfy the following relation:

$$D = A \frac{I^{\frac{2m+1}{m+1}}}{G^{\frac{m}{m+1}} \cdot U^{\frac{1}{m+1}}} \quad (1)$$

$$\text{with } m > -0.5, \quad (2)$$

where

D is the diameter of each exit opening of an auxiliary hollow electrode of a plasmatron of each assembly, both cathode and anode (in meters);

A is a constant for a given pressure and type of the plasma-forming medium, for each plasmatron;

$I=(I'/n)$ is the arc current through each plasmatron (in amperes);

I' is the arc current through the discharge chamber of the plasma generator (in amperes);

n is the number of plasmatrons in an electrode assembly;

G is the flow rate of the plasma-forming medium through a plasmatron (in kg/s);

U is the voltage drop across the interval between the end electrode of a plasmatron and the conducting portion of the electric arc in the discharge chamber near the exit opening of an auxiliary hollow electrode (in volts);

m is a dimensionless coefficient.

Such a design of the cathode assembly permits the arc current through the discharge chamber to be distributed among several cathodes and anodes. This minimizes the electrode erosion and prolongs the service life of the plasma generator as a whole.

Both electrode assemblies being made as a plurality of plasmatrons whose hollow electrodes communicate with the discharge chamber ensures reliable operation of the plasma generator even when erosive plasma-forming media are fed into the discharge zone of the discharge chamber as well as when a mixture of a pulverized solid fuel and a gaseous oxidizing agent is supplied to the electrode portions in contact with the electric arc.

The diameter of the exit opening of each auxiliary hollow electrode of a plasmatron of each assembly, both cathode and anode, being selected to satisfy Eq. (1) and Ineq. (2) enables the electric-arc discharge to be sustained with a rising current-voltage characteristic. This ensures reliable and even distribution of the arc current through the discharge chamber among several cathodes and anodes. In addition, any inadvertent voltage drop between the end electrode of a plasmatron of an electrode assembly and the conducting portion of the electric arc through the discharge chamber near the exit portion of an auxiliary hollow electrode, with a rising current-voltage characteristic, is accompanied by a decrease in the discharge current through that particular plasmatron, which protects the electrodes against heavy wear.

If Eq. (1) and Ineq. (2) are satisifed in selecting the diameter of the exit opening of each auxiliary hollow electrode of each plarmatron, ballast resistors in the power circuit of each cathode and anode of both electrode assemblies are no more necessary and the plasma generator can be energized from a single power supply.

All this improves the efficiency, reliability and service life of the plasma generator, as well as permits cutting down the size and weight of the equipment.

Other objects and advantages of the invention will become more evident from the following description taken in conjunction with the accompanying drawing which is a schematic longitudinal-section view of a plasma generator according to the invention, with its power supply and arc initiating systems.

Referring now to the drawing, the plasma generator comprises a discharge chamber 1 provided with an inlet pipe 2 for feeding a plasma-forming medium and associated with a cathode assembly 3 and an anode assembly 4. The cathode assembly 3 and anode assembly 4 are arranged coaxially on either side of the discharge chamber 1. The latter has a cooling system including an inlet channel 5 communicating with a coolant inlet pipe 6, an outlet channel 7 communicating with a coolant outlet pipe 8, and a slotted channel 9. The latter is made slotted to ensure intensive heat removal from the wall of the discharge chamber 1.

The pipes 6 and 8 are secured to the body of the discharge chamber 1. The cathode assembly 3 and anode assembly 4 are insulated from the discharge chamber 1 by insulators 10.

The cathode assembly 3 has a housing 11 threaded whereto are plasmatrons 12. The housing 11 has a cooling channel 13.

A plasmatron 12 comprises a casing 14 in which an auxiliary hollow electrode 15 is coaxially arranged. The electrode 15 is provided with a cooling jacket 16. The latter accommodates a coolant inlet pipe 17 and a coolant outlet pipe 18.

Arranged coaxially with the electrode 15 in the casing 14 is an end electrode 19 provided with a cooling system including a coolant inlet pipe 20 and a coolant outlet pipe 21. The electrodes 15 and 19 are mutually insulated by means of an insulator 22. Made in the casing 14 is a tangential opening 23 to let a plasma-forming medium, for example a mixture of water steam and oxygen, into the plasmatron 12. The cathode assembly 3 comprises at least two identical plasmatrons 12. The electrodes 15 have exit openings 24 which are evenly distributed along the perimeter of the cross section of the discharge chamber 1.

The anode assembly 4 has a housing **11*a* threaded whereto are plasmatrons 12*a*. The housing 11*a* is provided with a cooling channel 13*a***.

A plasmatron **12*a* comprises a casing 14*a* in which an auxiliary hollow electrode 15*a* is coaxially installed. The electrode 15*a* has a cooling jacket 16*a*. The latter is provided with a coolant inlet pipe 17*a* and an outlet coolant pipe 18*a***.

Arranged coaxially with the electrode **15*a* in the casing 14*a* is an end electrode 19*a* provided with a cooling system including a coolant inlet pipe 20*a* and a coolant outlet pipe 21*a*. The electrodes 15*a* and 19*a* are mutually insulated by means of an insulator 22*a*. Made in the casing 14*a* is a tangential opening 23*a* to let in a plasma-forming medium, for example argon, hydrogen, or a mixture of steam and oxygen. The anode assembly 4 has at least two identical plasmatrons 12*a*. The electrodes 15*a* have exit openings 24*a* which are evenly distributed along the perimeter of the cross section of the discharge chamber 1. The number of plasmatrons 12 and 12*a* in the electrode assemblies 3 and 4** may vary accordingly.

The pipe 2 has a central hole 25 for feeding a pulverized solid fuel, such as coal or shale, and radial holes 26 for feeding an oxidizing agent, such as a mixture of steam and oxygen.

The diameter of each opening 24 or **24*a*** is selected to satisfy the following condition:

$$D = A \frac{I^{\frac{2m+1}{m+1}}}{G^{\frac{m}{m+1}} \cdot U^{\frac{1}{m+1}}} \quad (1)$$

$$\text{with } m > -0.5, \quad (2)$$

where

D is the diameter of each exit opening 24 or **24*a* of the auxiliary hollow electrode 15 or 15*a***;

A is a constant for a given pressure and type of the plasma-forming medium, for each plasmatron 12 or **12*a***;

I=(I′/n) is the arc current through each plasmatron 12 or **12*a***;

I′ is the arc current through the discharge chamber 1;

n is the number of plasmatrons in an electrode assembly;

G is the flow rate of the plasma-forming medium through a plasmatron 12 or **12*a***;

U is the voltage drop across the interval between the end electrode 19 or **19*a* and the conducting portion of the electric arc in the discharge chamber 1 near the exit opening 24 or 24*a***;

m is a dimensionless coefficient.

The auxiliary hollow electrodes 15 and **15*a*, as well as the end electrodes 19 and 19*a* of the plasmatrons 12 and 12*a*, respectively, are connected to a discharge initiating system 27 or 27*a* of the plasmatron 12 or 12*a***.

The end electrodes 19 of the plasmatrons 12 are connected to the negative terminal of a power supply 28, while the end electrodes **19*a* of the plasmatrons 12*a* are connected via a switch 29 to the positive terminal of the power supply 28**.

The discharge initiating system 27 in a plarmatron 12 comprises a power supply 30 connected to the end electrode 19 via a switch 31 and to the casing 14 via a semiconductor rectifier 32. The latter is connected into the circuit so that with the contact of the switch 31 closed no current flows from the power supply 28 through the circuit:switch 31-power supply 30-semiconductor rectifier 32-casing 14.

The discharge initiating system **27*a* in a plasmatron 12*a* comprises a power supply 30*a* connected to the end electrode 19*a* via a switch 31*a* and to the casing 14*a* via a semiconductor rectifier 32*a***. The latter is connected into the circuit so that with the contacts of the switch 31*a* the arc-discharge current in the discharge chamber 1 does not flow through the circuit: casing 14*a*-semiconductor rectifier 32*a*-power supply 30-switch 31-switch 29-power supply 28.

The surfaces of the end electrodes 19 and 19*a*, facing the auxiliary hollow electrodes 15 and 15*a*, are made of a material ensuring maximum service life of the electrodes at a given polarity thereof and a given composition of the plasma-forming gas. For example, the end electrodes of the cathode assembly 3 are made of metallic zirconium when a mixture of oxygen and steam is fed into the plasmatron 12, or of tungsten when fed into the plasmatron 12 is argon or nitrogen.

The end electrodes 19*a* of the anode assembly 4 should preferably be made of copper, irrespective of the plasma-forming medium used.

If, at a given electrode material, the erosion of the cathode at the rated current is heavier than that of the anode the number of plasmatron in the cathode assembly should exceed that of plasmatrons in the anode assembly, this number being selected so as to ensure the same time of continuous operation of the end electrodes.

The proposed plasma generator operates as follows.

With the generator circuit being open, that is when the contacts of the switch 29 are open, an oxidizing agent, such as a mixture of steam and oxygen, is fed into the discharge chamber 1 through the radial holes 26 of the pipe 2, while plasma-forming media are supplied into the plarmatrons 12 and 12*a* through the openings 23 and 23*a*. Then, the discharge initiating systems 27 and 27*a* in each plasmatron 12 and 12*a* of the electrode assemblies 3 and 4 are energized. When the contacts of the switch 31 make, a voltage is applied from the power supply 30 to the electrodes 15 and 19 via the semiconductor rectifier 32. An arc discharge A is initiated between the above electrodes. When the oxidizing agent flows through the arc discharge, a plasma jet is formed in the hollow electrode 15, which enters the discharge chamber 1 through the exit opening 24. The plasma jet is essentially a conducting ionized gas. When current I flows through the ionized stream, voltage drop U occurs across the interval between the end electrode 19 and the conducting portion of the electric arc near the exit opening 24.

At the same time, the contacts of the switch 31*a* make, and a voltage is applied from the power supply 30*a* to the electrodes 15*a* and 19*a* via the semiconductor rectifier 32*a*. An arc discharge appears between these electrodes.

When the oxidizing agent flows through the arc discharge, a plasma jet is formed in the hollow electrode 19*a*, which enters the discharge chamber 1 through the exit opening 24*a*. Voltage drop U occurs across the interval between the end electrode 19*a* and the conducting portion of the electric arc near the exit opening 24*a*.

Then, the contacts of the switch 29 make, and the voltage from the power supply 28 is applied to the end electrodes 19 and 19*a* of the plasmatrons 12 and 12*a* of the cathode assembly 3 and the anode assembly 4.

An arc discharge B is initiated between the two ionized conducting portions of the electric arc of the plasmatron 12 near the exit opening 24 and that of the plasmatron 12*a* near the exit opening 24*a*. Thereafter, the contacts of the switches 31 and 31*a* break.

Thus, the hollow electrodes 15 and 15*a* perform an auxiliary function and serve as electrodes only to start the plasma generator.

Since the diameters of the exit openings 24 and 24*a* of the auxiliary hollow electrodes 15 and 15*a* satisfy Eq. (1) and Ineq. (2), the electric-arc discharge in each plasmatron 12 and 12*a* is sustained with a rising current-voltage characteristic. As a result, the discharge in each plasmatron 12 and 12*a* is essentially an effective resistance, that is it becomes possible to provide several parallel arc discharges without introducing additional components into the power circuit of these discharges, which, in turn, ensures equality of current I through each one of the parallel arc discharges at the same flow rate (G) of the plasma-forming medium through the plasmatron 12 or 12*a*, at the same diameter (D) of the exit opening 24 or 24*a* of the auxiliary electrode 15 or 15*a*, and at the same voltage drop (U) across the interval between the end electrode 19 or 19*a* and the conducting portion of the electric arc near the exit opening 24 or 24*a*. In addition, all plasmatrons 12 or 12*a* of a particular electrode assembly must receive the same plasma-forming medium; then Eq. (1) holds for each plasmatron 12 or 12*a* of a given electrode assembly because parameter m for all plasmatrons of an electrode assembly is the same. The different electrode assemblies may receive different plasma-forming media.

Fed through the hole 25 of the pipe 2 into the discharge chamber 1 is a pulverized solid fuel, coal or shale, which is gasified in the zone of the discharge B by the ionized flow of the oxidizing agent, yielding a mixture of carbon monoxide and hydrogen ($CO+H_2$).

After gasification the reaction products flow out of the plasma generator.

Thus, the cathode assembly 3 comprising two plasmatrons 12 whose end electrodes 19 are connected to the power supply 28 and the auxiliary hollow electrodes 15 communicating with the discharge chamber 1 permits the life of the plasma generator to be substantially improved at any arc current by distribution of the rated current of the plasma current of the plasma generator among several electrodes 19 connected in parallel to the power supply 28.

Besides, both electrode assemblies 3 and 4 comprising several plasmatrons 12 and 12*a* whose auxiliary hollow electrodes 15 and 15*a* communicate with the discharge chamber 1 permits free supply, into the zone of the electric discharge of the plasma generator, of a necessary amount of a mixture of a pulverized solid fuel, such as coal, and an erosive oxidizing agent, such as a mixture of steam and oxygen, for gasification of the coal with the above oxidizing agent to obtain synthetic gas ($CO+H_2$) as a semiproduct in the processes of production of synthetic liquid fuel and pure hydrogen (for hydrogen power engineering and production of mineral fertilizers).

The significant simplification of the plasma generator's power supply system and reduction of its cost, ensuring its reliable operation from a single source without introducing any circuit components to stabilize several parallel electric discharges, are achieved by a simple and reliable means, namely selection of the diameter of each exit opening of the auxiliary hollow electrodes 15 and 15*a* of all plasmatrons in a particular electrode assembly to satisfy Eq. (1) and Ineq. (2).

This also allows the current to be automatically maintained equal in all plasmatrons of an electrode assembly, hence, providing for strictly the same erosion of each end electrode.

All of the above advantages permit the efficiency of the plasma generator to be improved by reducing the number of stationary power supplies or by excluding ballast resistors from the circuit of the end electrodes, which resistors tend to dissipate up to 50% of the supplied power, as well as by evenly distributing the rated arc current in the discharge chamber among several end electrodes of the electrode assembly.

The proposed plasma generator has been tested with air being used as the oxidizing agent, the end electrode in the cathode assembly being made of zirconium, and those in the anode assembly being made of copper.

The air flow rate through one plasmatron of an electrode assembly being 2.5 to 10 g/s, two plasmatrons of the cathode and anode assemblies, connected in parallel, were found to operate reliably for 300 hours in the arc current range of 80 to 250 A. The diameters of the exit openings of the auxiliary hollow electrodes were selected from the following relation:

$$D = 10^{3.84} \frac{I^{0.182}}{G^{-0.818} \cdot U^{1.82}}$$

with m = −0.45 and equalled 8 to 10 mm depending on the arc current in the plasmatron.

While this invention has been described with reference to a preferred embodiment thereof, it will be understood by those skilled in the art that various changes in form and details may be made therein without departing from the spirit and scope of the invention.

What is claimed:

1. A plasma generator comprising: a discharge chamber; a means for introducing a plasma-forming medium into said discharge chamber, installed on said discharge chamber; a cathode assembly associated with said discharge chamber and comprising at least two plasmatrons; an anode assembly associated with said discharge chamber and comprising at least two plasmatrons; a power supply; a system for initiating an arc discharge in each plasmatron; an inlet for the plasma-forming medium in each plasmatron; an end electrode in each plasmatron of said cathode assembly, connected to said arc discharge initiating system and to said power supply; an auxiliary hollow electrode in each plasmatron of said cathode assembly, connected to said arc discharge initiating system and having an exit opening communicating with said discharge chamber, the diameter of said exit opening being selected to satisfy the following relation:

$$D = A \frac{I^{\frac{2m+1}{m+1}}}{G^{\frac{m}{m+1}} \cdot U^{\frac{1}{m+1}}} (m),$$

where m is a dimensionless coefficient;

$m > -0.5$

A is a constant for a given pressure and type of the plasmaforming medium for each plasmatron of said cathode assembly;

I=(I′/n) is the arc current through each plasmatron of said cathode assembly (in amperes);

I′ is the arc current through said discharge chamber (in amperes);

n is the number of plasmatrons in said cathode assembly;

G is the flow rate of the plasma-forming medium through a plasmatron of said cathode assembly (in Kg/s);

U is the voltage drop across the interval between the end electrode of a plasmatron of said cathode assembly and the conducting portion of the electric arc in said discharge chamber near said exit opening of said auxiliary hollow electrode of the plasmatron of said cathode assembly (in volts);

said end electrode in each plasmatron of said cathode assembly being connected to said arc discharge initiating system and to said power supply; said auxiliary hollow electrode in each plasmatron of said anode assembly being connected to said arc discharge initiating system and having an exit opening communicating with said discharge system, the diameter of said exit opening being selected to satisfy the following relation:

$$D = A \frac{I^{\frac{2m+1}{m+1}}}{G^{\frac{m}{m+1}} \cdot U^{\frac{1}{m+1}}} (m),$$

where m is a dimensionless coefficient;

$m > -0.5$

A is a constant for a given pressure and type of the plasma-forming mediums, for each plasmatron of said anode assembly;

I=(I′/n) is the arc current through each plasmatron of said anode assembly (in amperes);

I′ is the arc current through said discharge chamber (in amperes);

n is the number of plasmatrons in said anode assembly;

G is the flow rate of the plasma-forming medium through a plasmatron of said anode assembly (in kg/s);

U is the voltage drop across the internal between the end electrode of a plasmatron of said anode assembly and the conducting portion of the electric arc in said discharge chamber near said exit opening of said auxiliary hollow electrode of the plasmatron of said anode assembly (in volts).

* * * * *